United States Patent [19]

Crowley et al.

[11] 4,243,285

[45] Jan. 6, 1981

[54] CLAMP-PLUG TYPE CONNECTOR

[75] Inventors: Charles F. Crowley, Peabody; Albert R. Pratt, Weston, both of Mass.

[73] Assignee: Raytheon Company, Lexington, Mass.

[21] Appl. No.: 973,487

[22] Filed: Dec. 26, 1978

[51] Int. Cl.[3] ..... H01R 13/62; H01R 11/22

[52] U.S. Cl. ..... 339/32 R; 339/200 P; 339/255 P

[58] Field of Search ..... 339/200 P, 255 P, 31, 339/32, 75.

[56] References Cited

U.S. PATENT DOCUMENTS

| | | | |
|---|---|---|---|
| 1,799,747 | 4/1931 | Harvey . | |
| 2,423,660 | 7/1947 | Reynolds | 339/255 P X |
| 2,574,043 | 11/1951 | Lannou | 339/200 P X |
| 2,754,490 | 7/1956 | Schnoll | 339/255 P |
| 3,374,455 | 3/1968 | Sullivan et al. | 339/255 P X |
| 3,605,066 | 9/1971 | Vierck, Sr. | 339/32 R |
| 3,850,490 | 11/1974 | Zehr | 339/255 P X |
| 4,057,313 | 11/1977 | Polizzano | 339/255 P X |
| 4,151,462 | 4/1979 | Teyler | 339/31 T X |

FOREIGN PATENT DOCUMENTS

| | | | |
|---|---|---|---|
| 1412660 | 8/1965 | France | 339/255 P |

*Primary Examiner*—John McQuade
*Assistant Examiner*—John S. Brown
*Attorney, Agent, or Firm*—John T. Meaney; Joseph D. Pannone

[57] ABSTRACT

A combination clamp and plug type electrical connector comprising a longitudinally extended pair of electrically conductive jaws mounted for relative pivotal movement and protruding from a dielectric sleeve having slidably supported therein resilient means for adjustably exerting an inwardly directed pressure on the jaws to maintain a clamping electrical contact with an interposed conductor, or for adjustably exerting an outwardly directed pressure on the jaws to maintain electrical contact with conductive wall portions of an electrical receptacle.

8 Claims, 7 Drawing Figures

CLAMP-PLUG TYPE CONNECTOR

BACKGROUND OF THE INVENTION

1. Field of the Invention

This invention relates generally to pressure connective devices and is concerned more particularly with an electrical connector having adjustable pressure means for maintaining electrical contact with an engaged conductor.

2. Discussion of the Prior Art

In testing an electrical circuit, selected portions of the circuit may be connected to electrical test equipment by means of pressure connectors attached to electrical jumper wires. A pressure connector may of the alligator clip type comprising a longitudinally extended pair of electrically conductive jaws which are pivotally mounted for closing on an interposed conductor. The jaws may be clamped in electrical contact with the interposed conductor by resilient means, such as the jaws being made of suitably contoured resilient material or urged toward one another by a suitably biased spring, for examples.

Alternatively, a pressure connector may be of the banana plug type comprising a cylindrical probe made of electrically conductive material which is slidably inserted into a test jack or other female receptable. Longitudinally extended surface portions of the probe may be maintained in electrical contact with conductive wall portions of the jack or receptacle by resilient means, such as the probe being made of longitudinally slotted resilient material or provided with longitudinally extended surface tongs, for examples. Thus, the banana plug connector maintains electrical contact with conductive wall portions of the jack or receptacle by pressure directed radially outwardly of the connector, whereas the alligator clip connector maintains electrical contact with a conductor disposed between the jaws by pressure directed radially inward of the connector.

In order to avoid time lost in changing from one of the described connectors to the other, there has been developed in the prior art a number of combination connectors which may be used for either type of pressure connection. However, these combination clamp and plug connectors generally require a combination of means for exerting pressure inwardly and outwardly of the connector. Furthermore, the pressure exerting means of these prior art combination connectors usually is not adjustable to avoid excessive pressure being exerted on an engaged conductor, and to release the pressure readily when disengagement is desired.

Therefore, it is advantageous and desirable to provide a combination clamp and plug type connector with a single adjustable means for exerting an inwardly or an outwardly directed pressure to maintain electrical contact with an engaged conductor, and for readily releasing the pressure when desired.

SUMMARY OF THE INVENTION

Accordingly, this invention provides a combination clamp and plug type electrical connector including a tubular housing and an alligator clip pair of electrically conductive jaw members having outer end portions protruding longitudinally from an end portion of the housing. The jaw members have interfitting intermediate portions mounted for relative pivotal movement in the end portion of the housing and respective inner end portions disposed in opposed spaced relationship within the housing. Supported for adjustable linear positioning within the housing is a resilient member having a curved end portion slidably engaging the inner surface of one of the jaw members.

Thus, movement of the resilient member toward the end portion of the housing causes the end portion of the resilient member to slide along the inner surface of the engaged jaw member and press the outer end portion thereof outwardly of the connector, thereby pivoting the jaws open. Conversely, movement of the resilient member in the reverse linear direction causes the terminal end portion of the resilient member to bear against the inner end portion of the engaged jaw member. As a result, the outer end portion of the engaged jaw member is pressed inwardly of the connector thereby pivoting the jaws closed.

Consequently, the resilient member may be adjustably positioned within the housing for exerting a desired clamping pressure on a conductor disposed between outer end portions of the jaw members and locking them in electrical contact therewith. Alternatively, the resilient member may be adjustably positioned within the housing for closing the outer end portions of the jaw members completely to form a cylindrical probe which may be inserted or plugged into a test jack or other female receptacle. Then, the resilient member may be adjustably positioned within the housing for opening the outer end portions of the jaw members sufficiently to lock longitudinal surface portions thereof into electrical contact with conductive wall portions of the jack or receptacle.

In a preferred embodiment of the invention, the tubular housing comprises a dielectric sleeve having protruding from one end portion thereof respective outer end portions of hollow jaw members made of electrically conductive material. Preferably, one of the jaw members is fixed and has an intermediate portion suitably disposed in the adjacent end portion of the sleeve for pivotally supporting an intermediate portion of the other jaw member. The fixed jaw member preferably extends longitudinally through the sleeve for electrical attachment adjacent the other end thereof to an electrical jumper wire.

Within the sleeve, the fixed jaw member has a generally U-shaped cross-sectional configuration to provide a guide channel for a slidable block supporting a coil spring. Preferably, the block carries a shaft which extends transversely of the sleeve and is encircled by the coil spring. A terminal end portion of the coil spring extends longitudinally between the hollow jaw member, and slidingly engages the inner surface of the pivotal jaw member. An extension tab of the spring support block projects through aligned slots in the sleeve and the channel portion of the fixed jaw member to provide manual control means for linearly positioning the spring in the channel portion of the jaw member and, as a result, determining the portion of the pivotal jaw member engaged by the terminal end portion of the spring.

BRIEF DESCRIPTION OF THE DRAWING

For a better understanding of the invention, reference is made in the following detailed description to the drawing wherein.

DESCRIPTION OF THE PREFERRED EMBODIMENT

Figure 1:
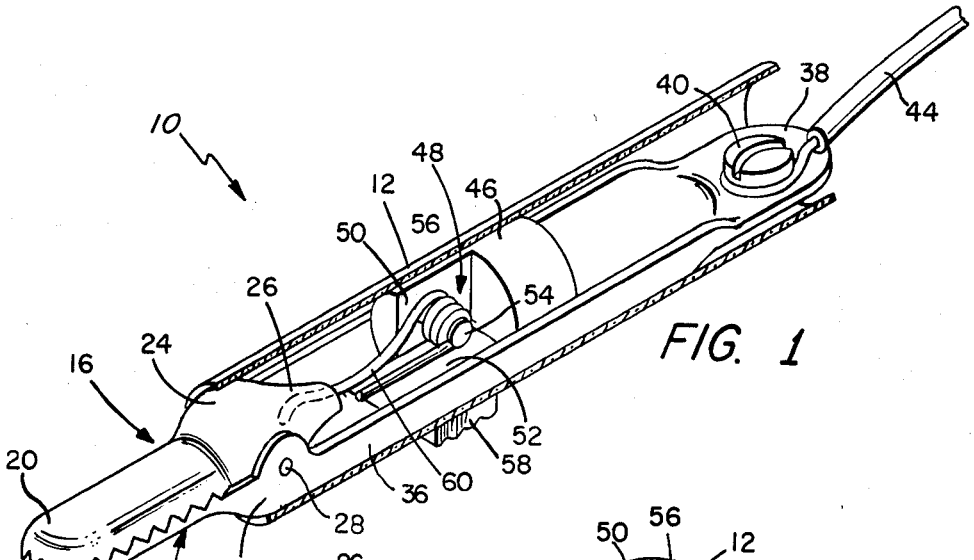
FIG. 1 is a perspective view, partly in section, of a combination clamp and plug type electrical connector embodying the invention.
Figure 3:
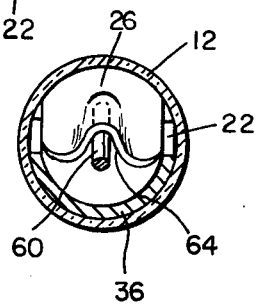
FIG. 3 is a transverse sectional view taken along the line 3—3 in FIG. 2 and looking in the direction of the arrows.
Figure 4:
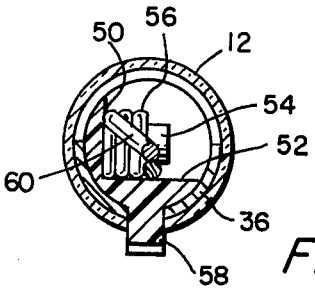
FIG. 4 is a transverse sectional view taken along the line 4—4 in FIG. 2 and looking in the direction of the arrows.

Referring to the drawing wherein like characters of reference designate like parts, there is shown in FIGS. 1–4 a combination clamp and plug type electrical connector 10 including a tubular housing or sleeve 12 which preferably is made of deformable dielectric material, such as polyurethane, for example. One end portion of sleeve 12 is aligned with an alligator clip pair of opposing jaw members, 14 and 16, respectively, which preferably are hollow and made of electrically conductive material, such as steel, for example. The jaw members 14 and 16 have respective elongated outer end portions, 18 and 20, respectively, protruding longitudinally from the adjacent end of sleeve 12 and disposed for pivotal clamping relationship with respect to one another. Outer end portions 18 and 20 preferably have respective configurations resembling the opposed jaws of an alligator, and have respective serrated rims which intermesh with one another when the jaws are completely closed. Alternatively, one of the outer end portions, such as 20, for example, may be dimensioned for fitting within the rim of the other end portion, when the jaws are completely closed.

Respective intermediate portions 22 and 24 of the jaw members 14 and 16 are attached to the outer end portions 18 and 20, respectively, and are interfittingly disposed for relative pivotal movement in the adjacent end portion of sleeve 12. The intermediate portion 24 is attached to an inner end portion 26 of jaw member 16 and is pivotally supported by the intermediate portion 22 of jaw member 14, which preferably is fixed. Each of the intermediate portions, 22 and 24, respectively, has a generally U-shaped cross-sectional configuration formed by a pair of substantially flat side walls having corresponding end portions attached to an interconnecting wall which preferably is provided with an arcuate curvature transversely of connector 10. The wall interconnecting side walls of intermediate portion 22 has an axially curved end portion adjacent the attached outer end portion 18 of fixed jaw member 14, and has an opposing end portion which is symmetrical with the axial centerline of connector 60. The wall interconnecting side walls of intermediate portion 24 may have a generally spherical curvature which is tapered axially adjacent the attached outer end portion 20 and adjacent the attached inner end portion 26 of pivotal jaw member 16.

Respective side walls of intermediate portion 24 may be suitably spaced for fitting between the respective side walls of intermediate portion 22 and aligned therewith. Extended transversely of connector 10 and through aligned apertures in the respective side walls of intermediate portions 22 and 24 is a pivot pin 28 about which the pivotal jaw member 16 is rotated. The intermediate portion 24 has a cam-like inner surface provided with a central crest portion 30 from which an axially sloped portion 32 extends outwardly of pivot pin 28 to join outer end portion 20 and an axially sloped portion 34 extends inwardly of pivot pin 28 to join inner end portion 26 of pivotal jaw member 16. Thus, the pivot pin 28 is located between the reverse angulated surfaces of sloped portions 32 and 34, respectively.

Axially aligned with intermediate portion 22 and attached thereto is an inner channel portion 36 of fixed jaw member 14. The inner channel portion 36 has a generally U-shaped cross-sectional configuration formed by a half-cylindrical wall which is transversely arcuate and axially symmetric with respect to the axial centerline of connector 10. Channel portion 36 extends axially substantially the entire length of sleeve 12 and is attached to a flatted terminal portion 38 of fixed jaw member 14 adjacent the other end of sleeve 12. The flatted terminal portion 38 may be provided with a threaded aperture 39 which is engaged by a terminal screw 40 and aligned with an access aperture 42 in the adjacent end portion of sleeve 12. Thus, a bared end portion of a jumper wire 44 may be curved under the head of screw 40 and a suitable tool, such as a screwdriver (not shown) for example, may be inserted through access aperture 42 to journal the terminal screw 40 bindingly into aperture 39. As a result, the jumper wire 44 is electrically connected through the fixed jaw member 14 to the outer end portions 18 thereof.

Slidably disposed in the inner channel portion 56 of fixed jaw member 14 is a cylindrical plug which is encircled by the dielectric sleeve 12. Plug 46 preferably is made of suitable dielectric material, such as phenolic, for example, and has a completely cylindrical end portion adjacent the flatted end portion 38 of jaw member 16. The opposing end portion of plug 46 includes an open end of a pie-shaped cavity 48 which extends longitudinally of the plug. Cavity 48 preferably is provided with right angle wall surfaces, 50 and 52, respectively, which extend a substantial length of plug 46 and terminate in a transverse surface at the completely cylindrical end portion of the plug. Extended outwardly from the wall surface 50 and transversely of connector 10 is a rigid post 54 which is encircled by a coil portion of a helical spring member 56. One terminal end portion of spring member 56 extends longitudinally of connector 10 and bears against the surface 52 of plug 46. Projecting radially outward from the exterior surface of plug 46 is a tab 58 which extends through aligned slots in the channel portion 46 of jaw member 14 and in the encircling sleeve 12. The tab 58 provides manual control means for sliding the plug 46 linearly along the channel portion 36 of fixed jaw member 14.

The spring member 56 has another terminal end portion 60 which extends from the coil portion thereof and longitudinally between the intermediate portions, 22 and 24, respectively, of the jaw members 14 and 16. Terminal end portion 60 preferably is provided with a curvature having a crest adjacent the coil portion of spring member 56, and intermediate nadir adjacent surface 52 of plug 46, and a terminal crest 62 adjacent the end thereof. As a result, the terminal crest 26 exerts a radially outwardly directed pressure against the inner cam-like surface of intermediate portion 24. The inner end portion 26 of intermediate portion 24 may have longitudinal portions pressed laterally inward thereof to provide an inverted, generally V-shaped groove 64 through which the terminal end portion 60 extends longitudinally. Thus, the groove 64 permits longitudinal slidable movement of spring member 56, and restricts lateral movement thereof.

Figure 2:
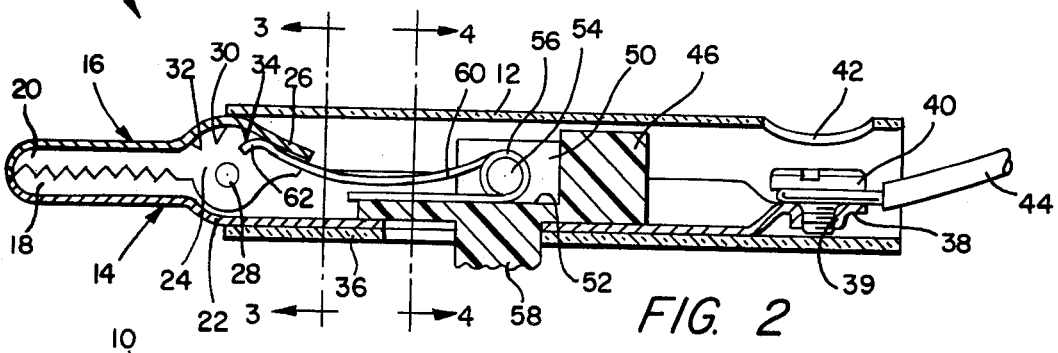
FIG. 2 is an axial view, partly in section, of the connector shown in FIG. 1 with the jaws closed.
Figure 5:
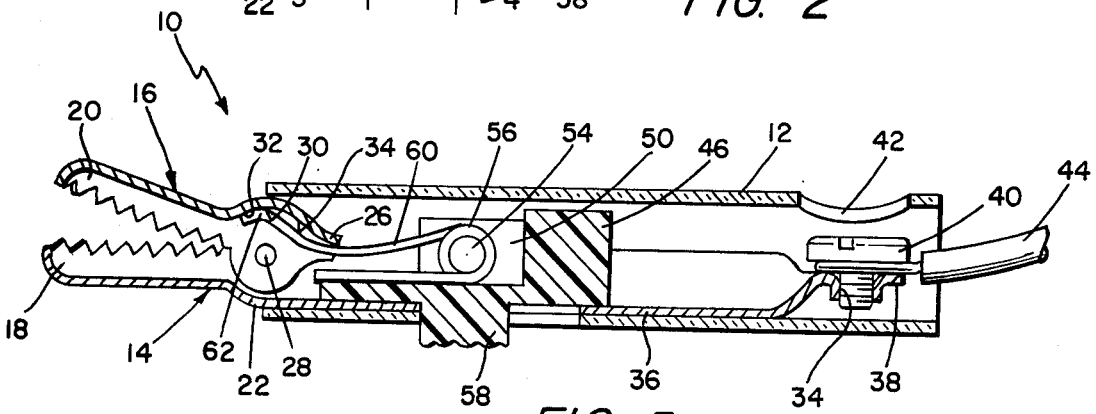
FIG. 5 is an axial view, partly in section, of the connector shown in FIG. 1 but with the jaws opened.
Figure 7:
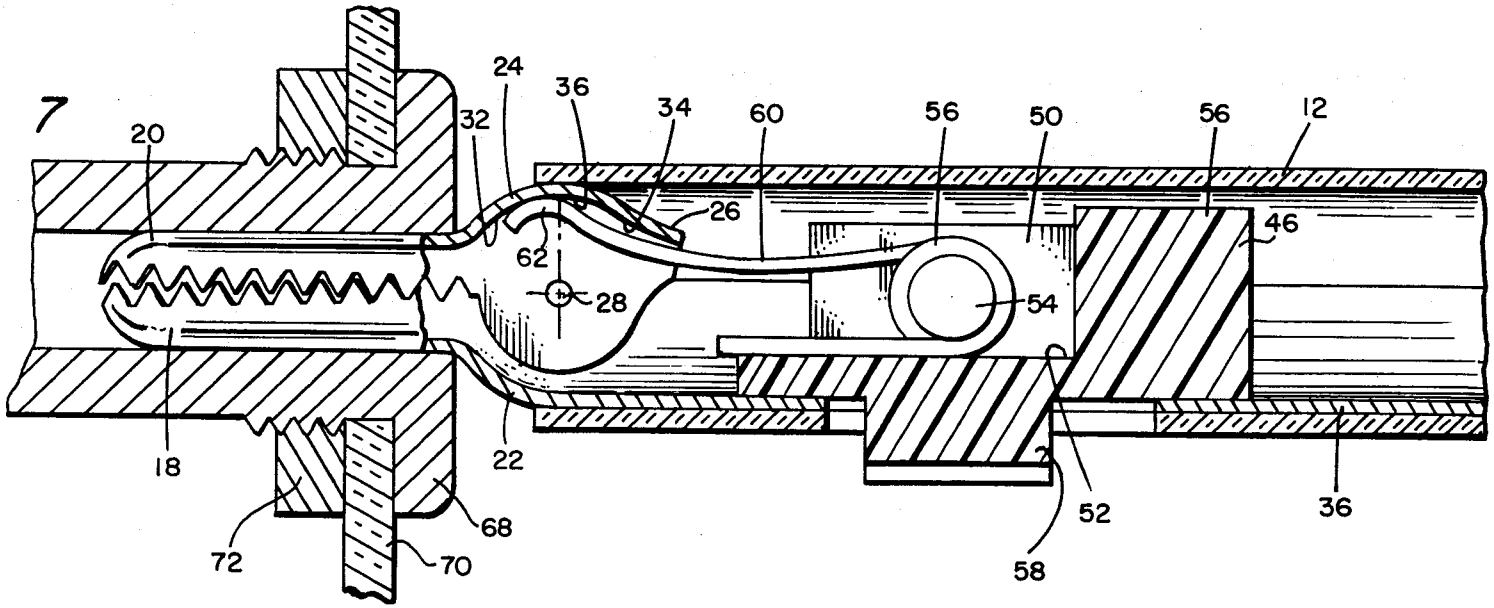
FIG. 7 is an enlarged axial view, partly in section, of the connector shown in FIG. 2 but plugged into a female receptacle and having the jaws adjustably locked open in electrical contact with wall portions of the receptacle.

Accordingly, when the projecting tab 58 is moved toward the flatted end portion 38 of fixed jaw 14 to slide the plug 46 correspondingly within channel portion 36 thereof, as shown in FIG. 2, the terminal crest 62 engages the axially sloped surface portion 34 located inwardly of pivot pin 28. The resulting outward pressure on surface portion 34 cause the pivotal jaw 16 to rotate about pin 28 and close the outer end portions 18 and 20, respectively, of jaw members 14 and 16. Conversely, when the projecting tab 58 is moved toward the outer end portions 18 and 20 to slide the plug 46 correspondingly within channel portion 36, as shown in FIG. 5, the terminal crest portion 62 of spring member 46 engages the axially sloped surface portion 32 located outwardly of pivot pin 28. Consequently, the outward pressure on surface portion 32 causes the pivotal jaw 16 to rotate in the reverse direction about pivot pin 28 and open the outer end portions 18 and 20, respectively, of jaw members 14 and 16.

Thus, the outer end portions 18 and 20 may be opened sufficiently, as shown in FIG. 5, to insert a conductor 66 therebetween. Then, tab 58 may be moved toward the flatted end portion 38 a sufficient distance for closing the outer end portions 18 and 20 on the conductor 66 and controllably clamping them in electrically contact therewith to connect the attached jumper wire 44 to the conductor 60. Tab 58 provide manual control means for regulating the radially directed pressure exerted on the sloped surface portion 34 and thereby adjusting the clamping pressure of the outer end portions 18 and 20, respectively, to prevent damaging the interposed conductor 66.

Figure 6:
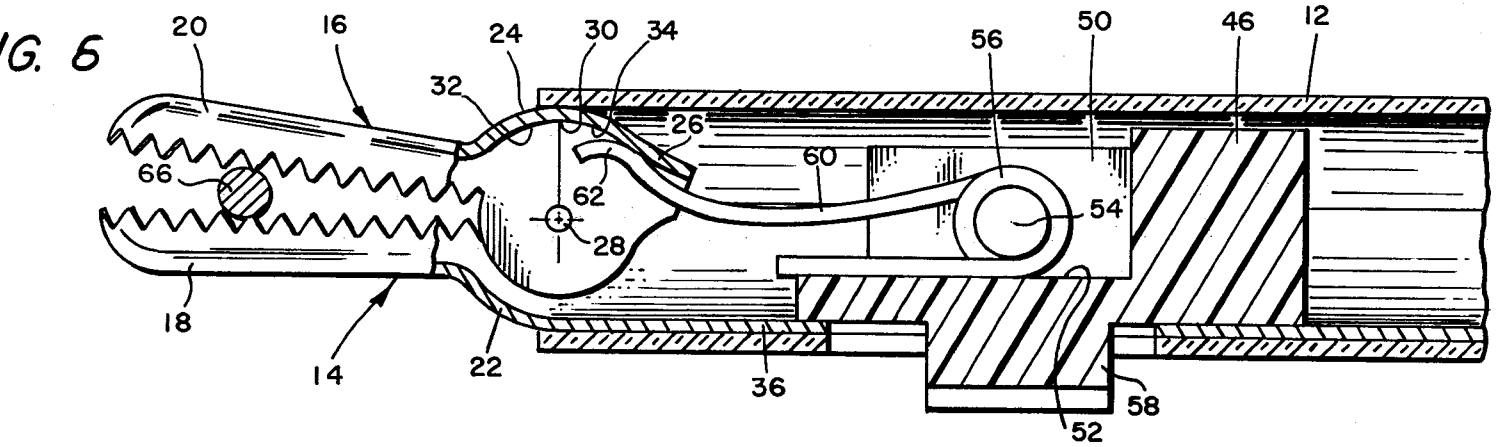
FIG. 6 is an enlarged axial view, partly in section, of the connector shown in FIG. 5 but having the jaws adjustably clamped on an interposed conductor.

Also, as shown in FIG. 6, the outer end portions 18 and 20 may be closed completely, as described, to form a cylindrical banana-type probe connector which is plugged into a test jack or receptacle 68 made of electrical material. The receptacle may be mounted in a dielectric panel 70 by suitable fastening means, such as engaged nut 72, for example. After insertion into receptacle 68, the outer end portions 18 and 20 may be opened by moving the tab 58 toward the outer end portions a sufficient distance for causing the terminal crest 62 of spring member 56 to exert a desired pressure on axially sloped surface portion 32. As a result, the pivotal jaw member 16 will be rotated about the pivot pin 28 to open the outer end portions 18 and 20 and lock them into adjustable electrical contact with conductive wall portions of the receptacle 68, thereby connecting the jumper wire 44 to the receptacle 68. Consequently, when rapid disengagement is required, the tab 58 may be moved toward the flatted end portion 38 to close the respective outer end portions 18 and 20 of jaw members 14 and 16 completely, whereby the connector 60 may be readily withdrawn from receptacle 68 if desired.

Thus, there has been disclosed herein a combination clamp and plug type electrical connector having an alligator clip pair of relatively pivotal jaw members, and single pressure means for adjustably clamping the jaw members in electrical contact with an interposed conductor, or adjustably locking lingitudianl surface portions of the jaw members in electrical contact with conductive wall portions of an electrical receptacle.

From the foregoing, it will be apparent that all of the objectives of this invention have been achieved by the structures shown and described herein. It also will be apparent, however, that various changes may be made by those skilled in the art without departing from the spirit of the invention as expressed in the appended claims. It is to be understood, therefore, that all matter shown and described herein is to be interpreted as illustrative and not in any limiting sense.

What is claimed is:

1. A pressure connective device comprising:

a pair of opposing jaw members having respective clamping portions disposed adjacent one another and respective other portions disposed for relative pivotal movement about an axis, one of said other portions having a surface provided with reverse angulated portions disposed on respective opposing sides of the axis; and means disposed between said other portions and movable to either side of said axis for pivotally biasing said clamping portions relative to one another in a selected direction, said means including adjustable pressure means urged against said surface of said one of the other portions for pivoting the jaw member in a desired direction, said adjustable pressure means including a resilient member movable along said surface.

2. A pressure connective device as set forth in claim 1 wherein the surface has reverse sloped portions joined to an interposed crest portion; and the resilient member comprises a slidable spring having a terminal end portion pressed against the surface of the other portion.

3. An electrical connector comprising:

a tubular housing;

an elongated pair of electrically conductive jaw members having respective end portions extended in clamping relationship from one end of the housing and respective other portions disposed for relative pivotal movement about a transverse axis; and means disposed between said other portions of the jaw members for pivoting one of said end portions thereof relative to the other in a selected direction, said means including a resilient member movable within the housing and having a portion urged against a surface of one of other portions of said jaw members.

4. An electrical connector as set forth in claim 3 wherein the surface of the other portion has reverse sloped portions disposed on respective opposing sides of the pivot pin, and joined to one another through an interposed crest portion of the surface.

5. An electrical connector as set forth in claim 4 wherein the resilient member comprises a coil spring supported for controlled linear movement in the housing and having a terminal end portion slidably pressed against the surface of the other portion of the jaw member.

6. A pressure connective device comprising:

a pair of jaw members mounted for relative pivotal movement about an axis, at least one of the members having an inner cam surface including first and second sloped portions disposed on either side of the axis; and means disposed between the jaw members and movable into pressure engagement with a selected one of the first and second sloped portions for biasing the jaw members in a selected direction.

7. A pressure connective device as set forth in claim 6 wherein the first and second sloped portions are reverse-sloped with respect to the axis.

8. A pressure connective device as set forth in claim 7 wherein the inner cam surface includes a crest portion disposed over the axis and merging with the reverse-sloped first and second portions on either side of the axis.

* * * * *